US007140846B2

(12) United States Patent
Yamamoto et al.

(10) Patent No.: US 7,140,846 B2
(45) Date of Patent: Nov. 28, 2006

(54) VACUUM PUMP HAVING MAIN AND SUB PUMPS

(75) Inventors: Shinya Yamamoto, Kariya (JP); Satoru Kuramoto, Kariya (JP); Osamu Uchiyama, Kariya (JP); Daisuke Sato, Kariya (JP); Mika Fujiwara, Kariya (JP); Masahiro Kawaguchi, Kariya (JP); Mamoru Kuwahara, Kariya (JP); Nobuaki Hoshino, Kariya (JP); Ryosuke Koshizaka, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 225 days.

(21) Appl. No.: 10/391,904

(22) Filed: Mar. 19, 2003

(65) Prior Publication Data

US 2003/0180153 A1 Sep. 25, 2003

(30) Foreign Application Priority Data

Mar. 20, 2002 (JP) ..... 2002-079264
Jan. 6, 2003 (JP) ..... 2003-000554

(51) Int. Cl.
*F04B 3/00* (2006.01)
*F04B 5/00* (2006.01)
*F04B 25/00* (2006.01)

(52) U.S. Cl. ..... 417/245; 417/423.1; 418/201.1

(58) Field of Classification Search ..... 417/245, 417/243, 246, 247, 248, 199.1, 201, 206, 417/416.4, 357, 423.1; 418/201.01, 201.02, 418/9, 15

See application file for complete search history.

(56) References Cited

U.S. PATENT DOCUMENTS

| | | | | |
|---|---|---|---|---|
| 2,368,013 | A * | 1/1945 | Ford | 417/261 |
| 2,389,918 | A * | 11/1945 | Macgill | 417/571 |
| 4,291,547 | A * | 9/1981 | Leo | 62/402 |
| 4,832,581 | A * | 5/1989 | Muller et al. | 417/383 |
| 4,974,318 | A * | 12/1990 | Heppekausen et al. | 29/888.023 |
| 5,040,949 | A | 8/1991 | Crinquette et al. | 417/205 |
| 5,118,251 | A * | 6/1992 | Saulgeot | 415/90 |
| 5,378,128 | A * | 1/1995 | Yanagisawa | 418/9 |
| 5,472,320 | A * | 12/1995 | Weisbrodt | 417/326 |
| 5,478,210 | A * | 12/1995 | Maruyama et al. | 417/203 |
| 5,564,907 | A | 10/1996 | Maruyama et al. | 417/252 |
| 5,584,669 | A | 12/1996 | Becker | 417/205 |
| 5,961,297 | A | 10/1999 | Haga et al. | 417/310 |
| 6,093,008 | A * | 7/2000 | Kirsten | 418/201.1 |
| 6,435,844 | B1 * | 8/2002 | Fukami | 417/395 |
| 6,468,056 | B1 * | 10/2002 | Murakoshi | 417/395 |
| 6,589,023 | B1 * | 7/2003 | Royce et al. | 417/251 |
| 6,644,931 | B1 * | 11/2003 | Puech | 417/205 |

FOREIGN PATENT DOCUMENTS

| | | |
|---|---|---|
| DE | 1 184 447 | 12/1964 |
| DE | 37 10 782 A1 | 10/1988 |

(Continued)

*Primary Examiner*—William H. Rodriguez
(74) *Attorney, Agent, or Firm*—Morgan & Finnegan, LLP

(57) ABSTRACT

A vacuum pump having a rotary shaft that is rotated by a drive source has a main pump and a sub pump. The main pump includes a pump chamber and a gas transferring body that is located in the pump chamber. The main pump is driven by the drive source through the rotary shaft for transferring gas to an exhaust space. The sub pump is connected to the exhaust space for partially exhausting the gas from the exhaust space. The sub pump is driven by the same drive source. The displacement volume of the sub pump is smaller than that of the main pump.

8 Claims, 12 Drawing Sheets

FOREIGN PATENT DOCUMENTS

| | | | |
|---|---|---|---|
| DE | 42 32 119 | A1 | 3/1994 |
| DE | 44 43 387 | C1 | 1/1996 |
| EP | 1 101 942 | A2 | 5/2001 |
| EP | 1 101 943 | A2 | 5/2001 |
| JP | 60-97395 | | 7/1985 |
| JP | 60-247075 | | 12/1985 |
| JP | 62-101896 | | 5/1987 |
| JP | 62-243982 | | 10/1987 |
| JP | 03-033492 | | 2/1991 |
| JP | 06-129384 | | 5/1994 |
| JP | 10-184576 | | 7/1998 |
| JP | 2002070776 | A * | 8/2002 |

* cited by examiner

VACUUM PUMP HAVING MAIN AND SUB PUMPS

BACKGROUND OF THE INVENTION

The present invention relates to a vacuum pump that drives a gas transferring body in a pump chamber by rotation of a rotary shaft so as to transfer gas to generate vacuum action.

In a screw type vacuum pump disclosed in Unexamined Japanese Patent Publication No. 10-184576, an exhaust unit having a smaller displacement volume than the vacuum pump is connected to an exhaust region of the vacuum pump. The exhaust unit lowers pressure in the exhaust region of the vacuum pump. Namely, the exhaust unit prevents gas in the exhaust region from flowing back to a closed space in the vacuum pump. This prevention reduces a power loss of the vacuum pump so that power consumption is reduced on the vacuum pump.

An unwanted feature is that the exhaust unit is driven by an additional drive source that differs from a drive source of the vacuum pump. Since the additional drive source is provided for driving the exhaust unit, the size of the vacuum pump becomes relatively large. In addition, manufacturing costs for the vacuum pump increase. Therefore, there is a need for a vacuum pump that reduces power consumption without increasing the size of the vacuum pump and the manufacturing costs.

SUMMARY OF THE INVENTION

In accordance with the present invention, a vacuum pump having a rotary shaft that is rotated by a drive source has a main pump and a sub pump. The main pump includes a pump chamber and a gas transferring body that is located in the pump chamber. The main pump is driven by the drive source through the rotary shaft for transferring gas to an exhaust space. The sub pump is connected to the exhaust space for partially exhausting the gas from the exhaust space. The sub pump is driven by the same drive source. The displacement volume of the sub pump is smaller than that of the main pump.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of the present invention will now be described in reference to FIGS. 1 through 6. The front side and the rear side of a multi-stage roots pump or a vacuum pump 11 respectively correspond to the left side and the right side of FIGS. 1 and 2.

Figure 1:
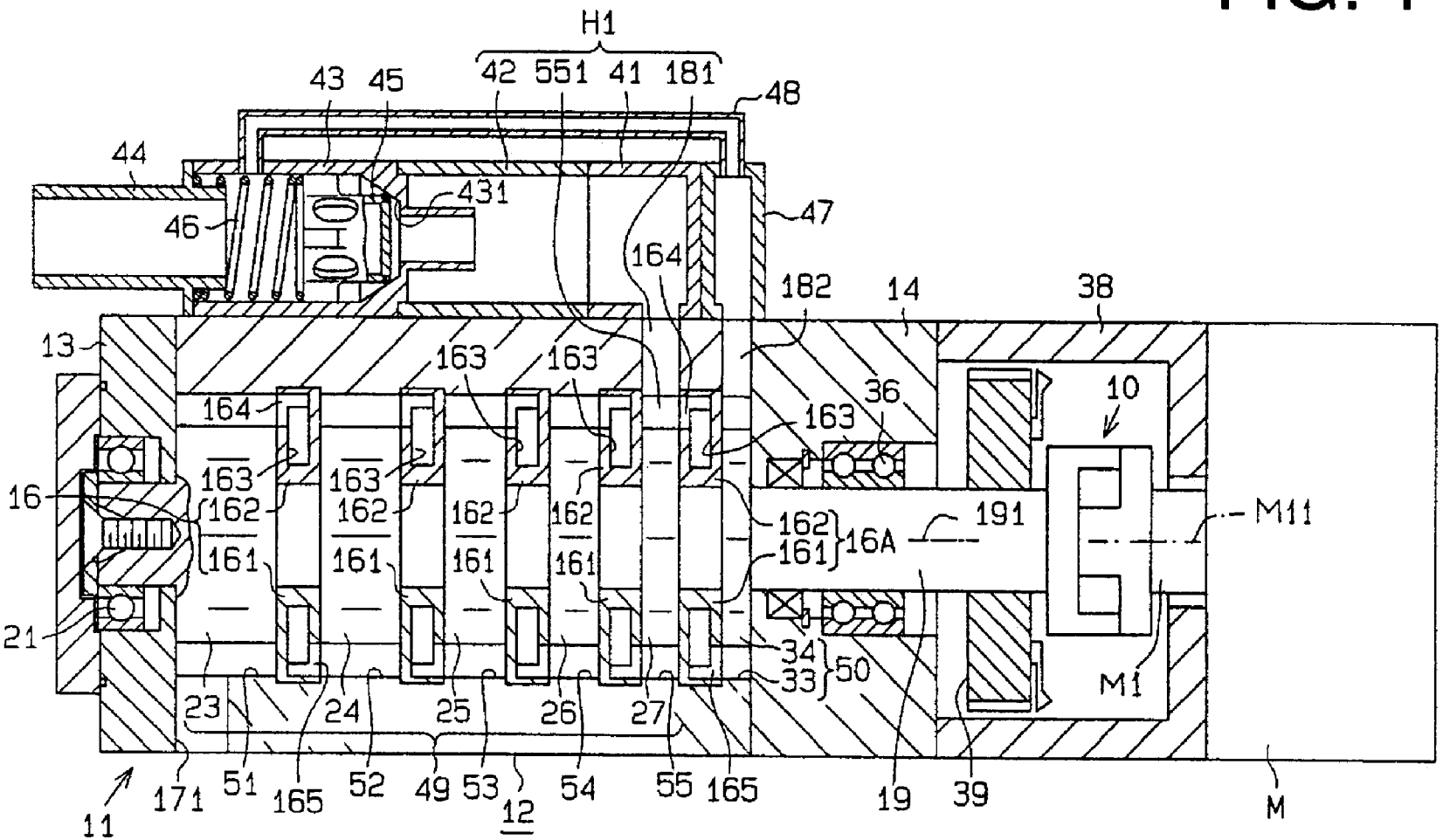
FIG. 1 is a longitudinal cross-sectional view of a multi-stage roots pump according to a first preferred embodiment of the present invention.

Now referring to FIG. 1, a diagram illustrates a longitudinal cross-sectional view of the multi-stage roots pump 11 according to the first preferred embodiment of the present invention. A housing of the multi-stage roots pump 11 includes a rotor housing 12, a front housing 13 and a rear housing 14. The front housing 13 is connected to the front end of the rotor housing 12. The rear housing 14 is connected to the rear end of the rotor housing 14.

The rotor housing 12 includes a cylinder block 15 and a plurality of partition walls 16, 16A. A main pump chamber 51 is defined between the front housing 13 and the frontmost partition wall 16. Main pump chambers 52, 53, 54 are respectively defined between the coadjacent partition walls 16. A main pump chamber 55 is defined between the rearmost partition wall 16 and the partition wall 16A. A sub pump chamber 33 is defined between the partition wall 16A and the rear housing 14. A passage 163 is respectively defined in each partition wall 16, 16A.

A flange 41, a muffler 42, a guide pipe 43 and an exhaust pipe 44 form a main gas passage for sending the gas that is exhausted from the multi-stage roots pump 11 to an exhaust gas control device, which is not shown in the drawing. The flange 41 is connected to the rotor housing 15. The inner space of the flange 41 communicates with the main pump chamber 55 through a main exhaust port 181. The muffler 42 is connected to the flange 41. The guide pipe 43 is connected to the muffler 42. The exhaust pipe 44 is connected to the guide pipe 43. The exhaust pipe 44 is connected to the exhaust gas control device.

A check valve or means for preventing the gas from flowing back is interposed in the main gas passage and includes the guide pipe 43, a valve body 45 and a return spring 46. The valve body 45 and the return spring 46 are located in the guide pipe 43. A tapered valve hole 431 is formed in the guide pipe 43, and the valve body 45 opens and closes the valve hole 431. The return spring 46 urges the valve body 45 in a direction to close the valve hole 431. An exhaust space H1 of the main pump 49 includes a semi-exhaust chamber 551, the main exhaust port 181, the inner spaces of the flange 41 and muffler 42.

A flange 47 and a sub exhaust pipe 48 form a sub gas passage for partially sending the gas in the main pump chamber 55 to the exhaust gas control device. The flange 47 is connected to the rear housing 14 and the rotor housing 15. The inner space of the flange 47 communicates with the sub pump chamber 33 through a sub exhaust port 182. The sub exhaust pipe 48 is connected to the flange 47 and is connected to the guide pipe 43 downstream of the valve body 45.

Figure 2:
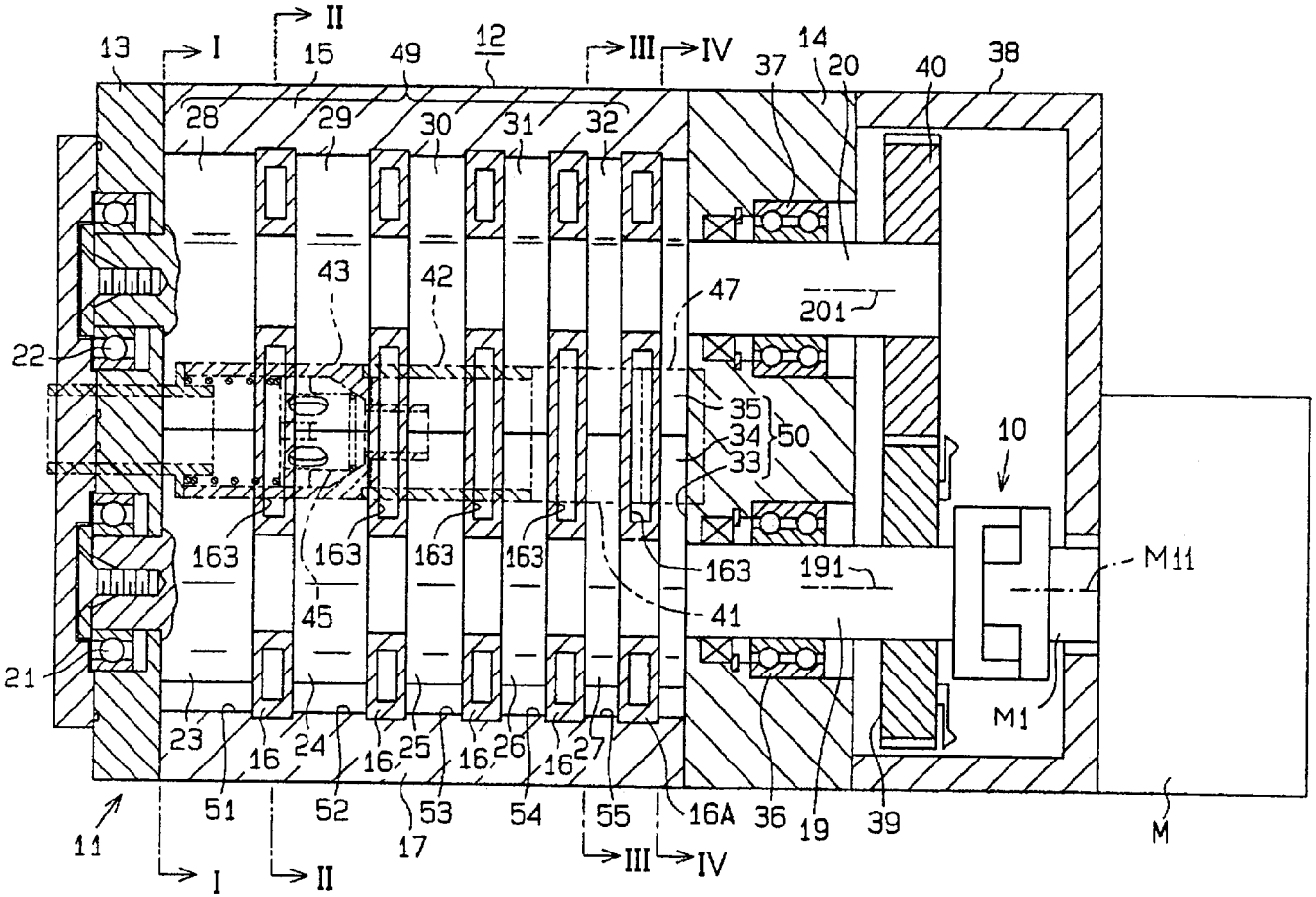
FIG. 2 is a cross-sectional plan view of the multi-stage roots pump according to the first preferred embodiment of the present invention.

Now referring to FIG. 2, a diagram illustrates a cross-sectional plan view of the multi-stage roots pump 11 according to the first preferred embodiment of the present invention. A rotary shaft 19 is supported by the front housing 13 and the rear housing 14 through radial bearings 21, 36, respectively. A rotary shaft 20 is also supported by the front housing 13 and the rear housing 14 through radial bearings 22, 37, respectively. The rotary shafts 19, 20 are located parallel with each other and extend through the partition walls 16,16A.

A plurality of main rotors or gas transferring bodies 23 through 27 are integrally formed with the rotary shaft 19. The same number of main rotors or gas transferring bodies 28 through 32 as the main rotors 23 through 27 are also integrally formed with the rotary shaft 20. A main pump 49 includes the main pump chambers 51 through 55 and the main rotors 23 through 32. Sub rotors 34, 35 are integrally formed with the rotary shafts 19, 20, respectively. A sub pump 50 includes the sub pump chamber 33 and the sub rotors 34, 35 and has a smaller displacement volume than the main pump 49. The main rotors 23 through 27 and the sub rotor 34 are the same in shape as seen in a direction of an axis 191 of the rotary shaft 19. Likewise, the main rotors 28 through 32 and the sub rotor 35 are the same in shape as seen in a direction of an axis 201 of the rotary shaft 20. The main rotors 23 through 27 reduce in thickness in order of 23, 24, 25, 26 and 27. Likewise, the main rotors 28 through 32 reduce in thickness in order of 28, 29, 30, 31 and 32. The sub rotors 34, 35 are respectively smaller in thickness than the main rotors 27, 32.

The main rotors 23, 28 are accommodated in the main pump chamber 51 in such a manner that they are engaged with each other by a small clearance. Likewise, the main rotors 24, 29 are accommodated in the main pump chamber 52 in such a manner that they are engaged with each other. Likewise, the main rotors 25, 30 are accommodated in the main pump chamber 53, the main rotors 26, 31 are accommodated in the main pump chamber 54, and the main rotors 27, 32 are accommodated in the main pump chamber 55. The sub rotors 34, 35 are accommodated in the sub pump chamber 33 in such a manner that they are engaged with each other by a small clearance. The main pump chambers 51 through 55 reduce in volume in order of 51, 52, 53, 54 and 55. The sub pump chamber 33 is smaller in volume than the main pump chamber 55.

A gear housing 38 is connected to the rear housing 14. The rotary shafts 19, 20 protrude into the gear housing 38 through the rear housing 14. Gears 39, 40 are respectively secured to the protruded ends of the rotary shafts 19, 20 and are engaged with each other. An electric motor or a drive source M is located in the gear housing 38. A drive shaft M1 of the electric motor M is connected to the rotary shaft 19 through a shaft coupling 10. The power of the electric motor M is transmitted to the rotary shaft 19 through the shaft coupling 10. The rotary shaft 20 is driven by the electric motor M through the engaged gears 39, 40. A main drive unit includes the drive shaft M1, the shaft coupling 10, the gears 39, 40 and the rotary shafts 19, 20 and transmits power from the electric motor M to the main pump 49 through the rotary shafts 19, 20.

Figure 3A:
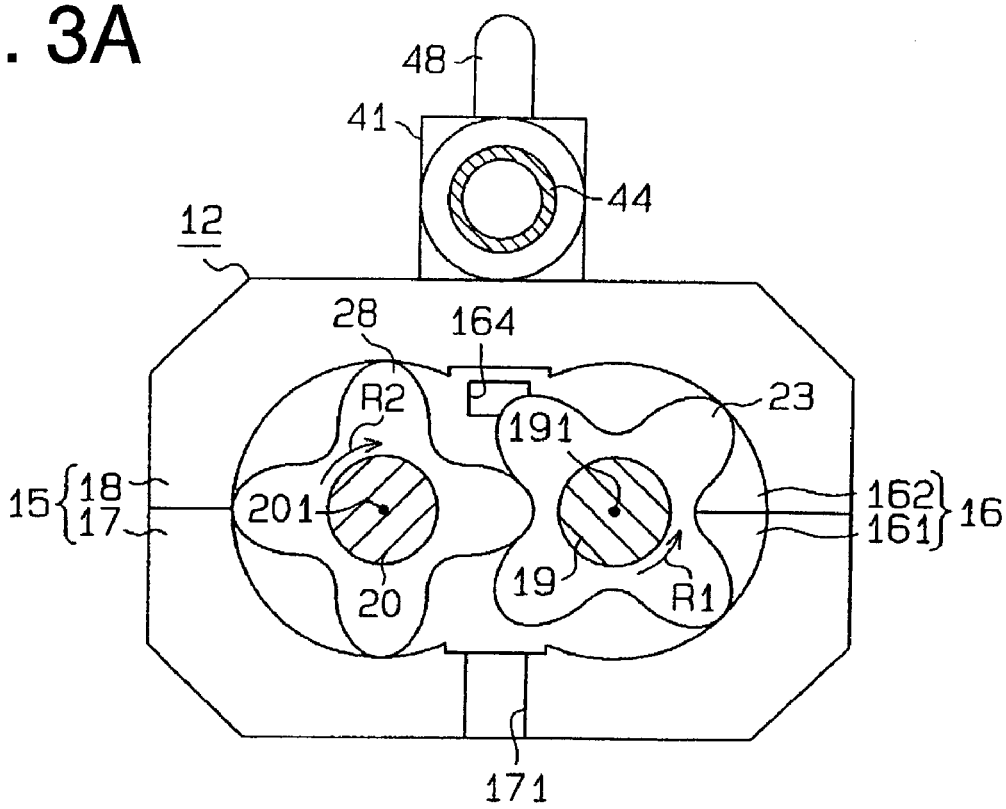
FIG. 3A is a cross-sectional end view that is taken along the line I—I in FIG. 2.

Now referring to FIG. 3A, a diagram illustrates a cross-sectional end view that is taken along the line I—I in FIG. 2. The cylinder block 15 includes a pair of block pieces 17, 18. The partition walls 16, 16A include a pair of wall pieces 161, 162. An intake port 171 is formed in the block piece 17 and communicates with the main pump chamber 51. An inlet 164 is formed in each wall piece 162 and interconnects the main pump chamber 51 and the passage 163.

Incidentally, the rotary shaft 19 is rotated by the electric motor M of FIG. 2 in a direction indicated by an arrow R1. The rotary shaft 20 is rotated in a direction indicated by an arrow R2, that is, in an opposite direction relative to the rotational direction of the rotary shaft 19.

Figure 3B:
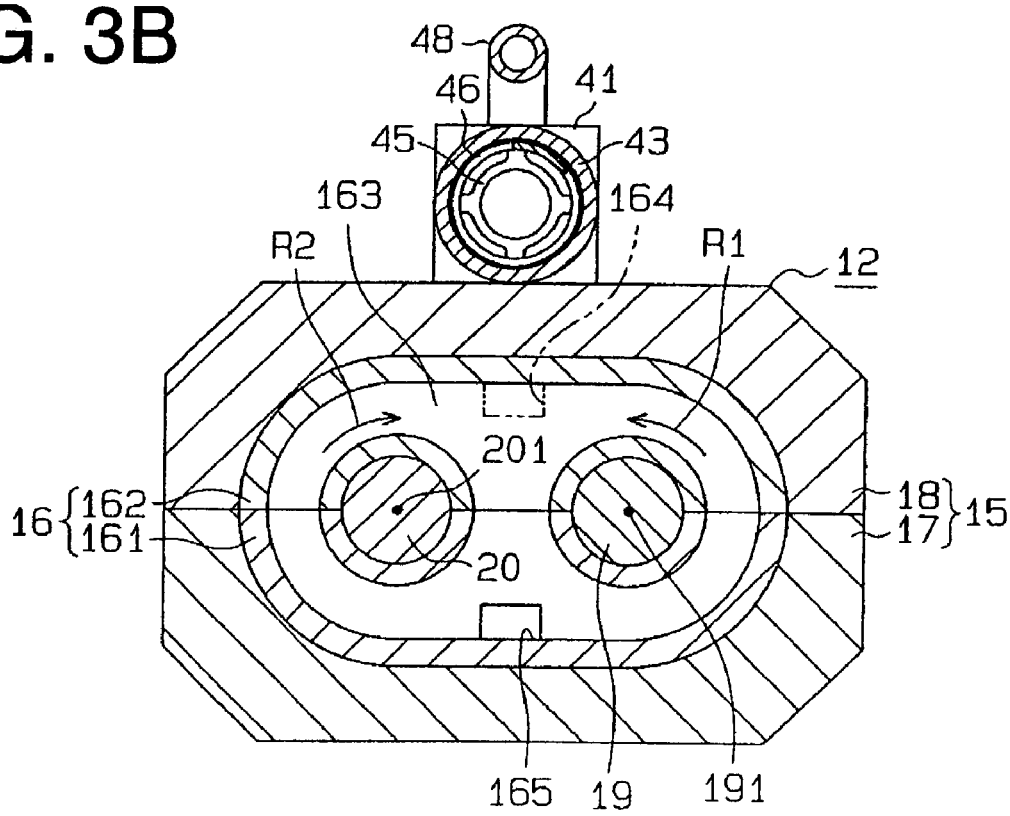
FIG. 3B is a cross-sectional end view that is taken along the line II—II in FIG. 2.

Now referring to FIG. 3B, a diagram illustrates a cross-sectional end view that is taken along the line II—II in FIG. 2. The passage 163 is formed in the partition wall 16. An outlet 165 is formed in the wall piece 161 and interconnects the main pump chamber 52 and the passage 163. Accordingly, the coadjacent main pump chambers 51 through 55 are interconnected with each other through the passage 163.

Figure 4A:
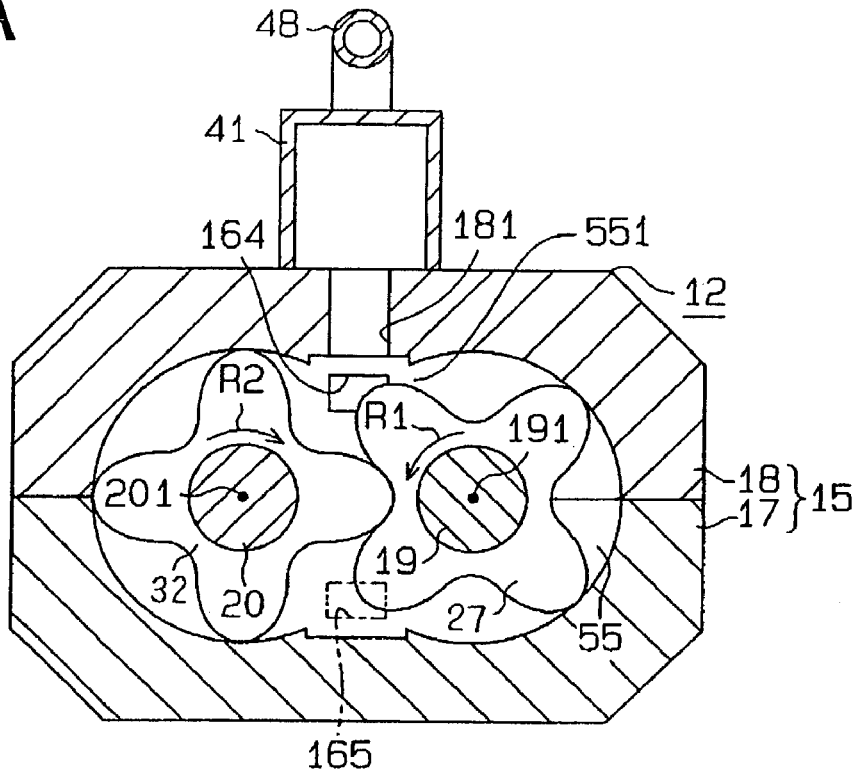
FIG. 4A is a cross-sectional end view that is taken along the line III—III in FIG. 2.

Now referring to FIG. 4A, a diagram illustrates a cross-sectional end view that is taken along the line III—III in FIG. 2. The main exhaust port 181 is formed in the block piece 18. The semi-exhaust chamber 551 is defined by the main rotors 27, 32 in the main pump chamber 55. The semi-exhaust chamber 551 communicates with the inner space of the flange 41 through the main exhaust port 181.

Referring back to FIG. 2, gas is introduced into the main pump chamber 51 through the intake port 171 and is transferred by the rotation of the main rotors 23, 28 to the next main pump chamber 52 through the inlet 164 of the partition wall 16, the passage 163 and the outlet 165. Likewise, the gas is transferred in order that the volume of the main pump chamber reduces, that is, in order of the main pump chambers 52, 53, 54 and 55. The gas transferred to the main pump chamber 55 is exhausted outside the rotor housing 12 through the main exhaust port 181.

Figure 4B:
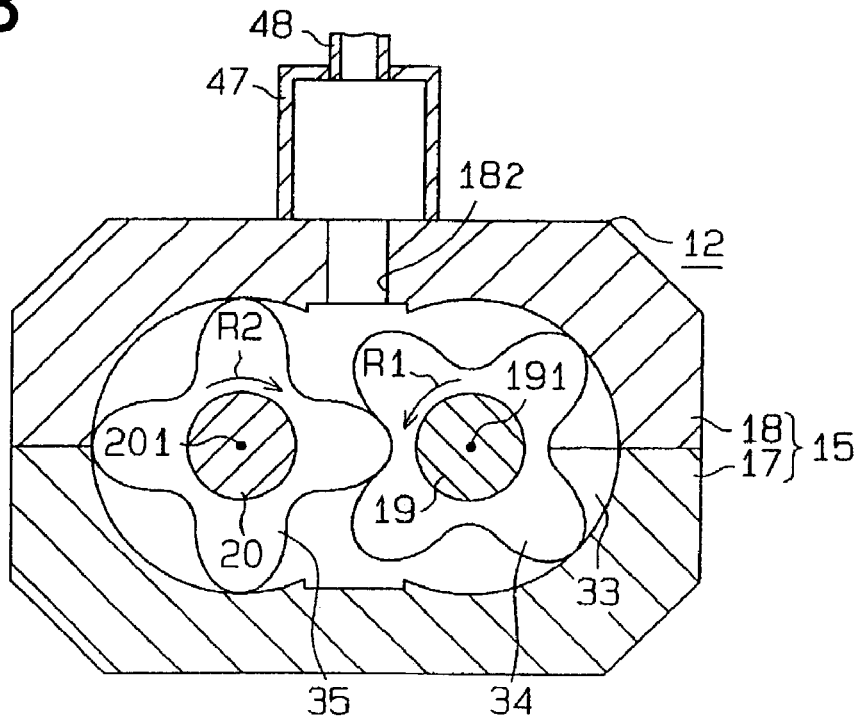
FIG. 4B is a cross-sectional end view that is taken along the line IV—IV in FIG. 2.

Now referring to FIG. 4B, a diagram illustrates a cross-sectional end view that is taken along the line IV—IV in FIG. 2. A sub exhaust port 182 is formed in the block piece 18 for communicating with the sub pump chamber 33. The gas in the main pump chamber 55 is partially transferred by the rotation of the sub rotors 34, 35 to the next sub pump chamber 33 through the inlet 164 of the partition wall 16A, the passage 163 and the outlet 165. The gas transferred to the sub pump chamber 33 is exhausted outside the rotor housing 12 through the sub exhaust port 182.

Referring back to FIG. 1, as the electric motor M is energized to rotate the rotary shafts 19, 20 of FIG. 2, the gas in a vacuumed space is introduced into the main pump chamber 51 of the main pump 49 through the intake port 171. The gas introduced into the main pump chamber 51 is transferred to the main pump chambers 55 through the main pump chambers 52 through 55 as it is compressed. When the flow rate of gas is large, almost all the gas transferred to the main pump chamber 55 is exhausted to the main gas passage through the main exhaust port 181, and the portion of gas is exhausted to the sub gas passage through the sub exhaust port 182 by the sub pump 50.

According to the first preferred embodiment, the following advantageous effects are obtained.

Figure 5:
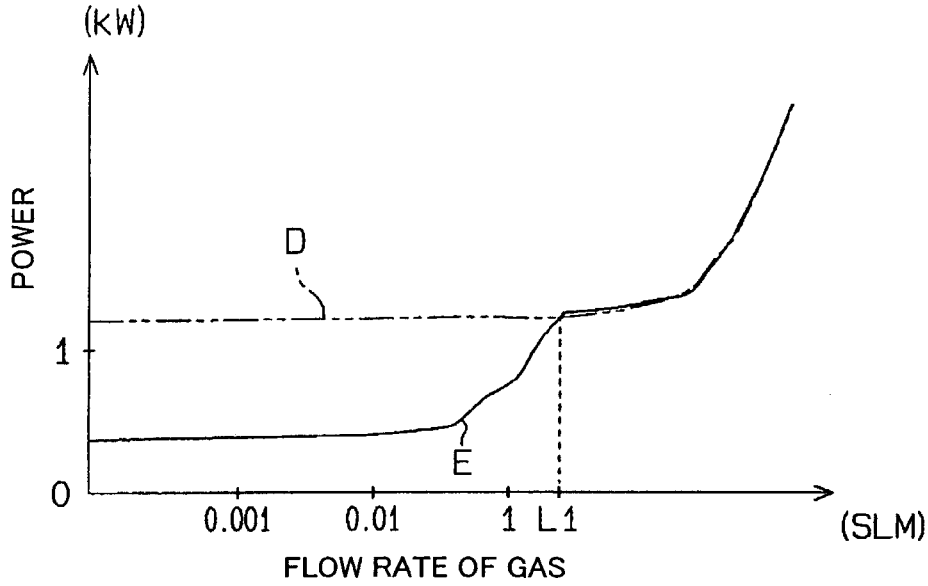
FIG. 5 is a graph showing power as a function of flow rate of gas for explaining reduction in power in the multi-stage roots pump with a sub pump.

(1-1) Referring to FIG. 5, a graph shows power as a function of flow rate of gas for explaining reduction in power in the multi-stage roots pump 11 with the sub pump 50. A curve D in the graph shows power as a function of flow rate of gas in a multi-stage roots pump without a sub pump. A curve E in the graph shows power as a function of flow rate of gas in the multi-stage roots pump 11 with the sub pump 50. When the flow rate of gas is lower than a certain flow rate, L1 in the graph, the power of the vacuum pump without a sub pump becomes uniform. However, when the multi-stage roots pump 11 has the sub pump 50, the power of the multi-stage roots pump 11 further reduces even if the flow rate of gas is lower than the flow rate L1.

Figure 6:
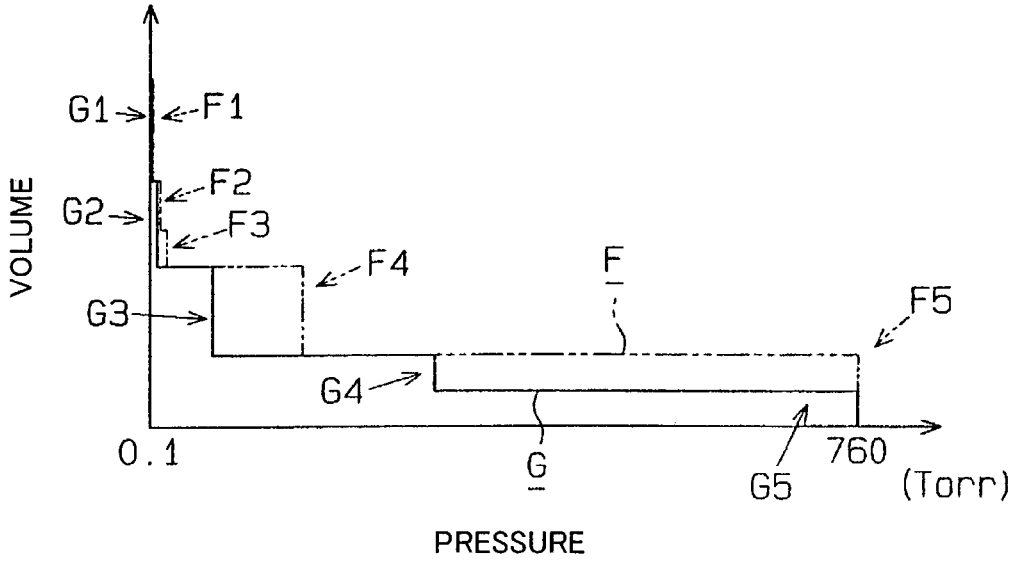
FIG. 6 is a graph showing a volume as a function of pressure in a main pump chamber for explaining reduction in power in the multi-stage roots pump with the sub pump.

Now referring to FIG. 6, a graph shows a volume as a function of pressure in a main pump chamber in the multi-stage roots pump 11 with the sub pump 50. A curve F in the graph shows volume as a function of pressure in the respective main pump chambers 51 through 55 in a multi-stage roots pump without a sub pump. A curve G in the graph shows volume as a function of pressure in the respective main pump chambers 51 through 55 in the multi-stage roots pump 11 with the sub pump 50. F1, F2, F3, F4, F5 in the curve F respectively correspond to the main pump chambers 51 through 55. G1, G2, G3, G4, G5 in the curve G respectively correspond to the main pump chambers 51 through 55. The area of a region defined by the curve F, the lateral axis and the longitudinal axis in the graph reflects power consumption in the multi-stage roots pump without a sub pump. The area of a region defined by the curve G, the lateral axis and the longitudinal axis in the graph reflects power consumption in the multi-stage roots pump 11 with the sub pump 50.

In comparison to a multi-stage roots pump without a sub pump, power consumption of the multi-stage roots pump 11 reduces in the first preferred embodiment when the flow rate of gas that corresponds to a desired degree of vacuum in the vacuumed space is lower than the flow rate L1. Namely, since the gas in the exhaust space H1 is exhausted by the sub pump 50 that has a smaller displacement volume than the main pump 49, pressure in the exhaust space H1 reduces in comparison to the multi-stage roots pump without a sub pump. The reduction of pressure in the exhaust space H1 leads pressure in the main pump chambers 51 through 55 to reduce. As a result, power consumption reduces in the multi-stage roots pump 11.

The sub pump 50 is driven by the electric motor M through the rotary shafts 19, 20 as well as the main pump 49. In other words, the drive sources of the sub pump 50 and the main pump 49 are the same electric motor M. Since an exclusive drive source for driving a sub pump is not employed, there is no occupied space for the exclusive drive source. Therefore, the multi-stage roots pump 11 becomes relatively compact and does not need costs for the exclusive drive source.

(1-2) As a gas passage between the exhaust space H1 and the sub pump 50 becomes short, flow resistance in the gas passage reduces. The sub pump 50 includes the sub pump chamber 33 and the sub rotors 34, 35 in the sub pump chamber 33. Then, the main pump 49 includes the main pump chambers 51 through 55 and the main rotors 23 through 32 that are located in the respective main pump chambers 51 through 55. The structure of the sub pump 50 is substantially the same as that of the main pump 49. The main pump chamber 55 on the last stage of the main pump 49 is coadjacent to the sub pump chamber 33. The multi-stage roots pump 11 internally accommodates the sub pump 50 in its housing so that the exhaust space H1 is located near the sub pump 50, and the gas passage between the exhaust space H1 and the sub pump 50 becomes relatively short. The flow resistance of the gas passage is reduced by shortening the gas passage between the exhaust space H1 and the sub pump 50 so that power consumption is reduced in the multi-stage roots pump 11.

(1-3) The multi-stage roots pump 11 uses a smaller power than a screw type vacuum pump so that the present invention is appropriately applied to the multi-stage roots pump 11.

A second preferred embodiment of the present invention will now be described in reference to FIGS. 7A and 7B. The same reference numerals denote the substantially identical components to those in the first preferred embodiment.

Figure 7B:
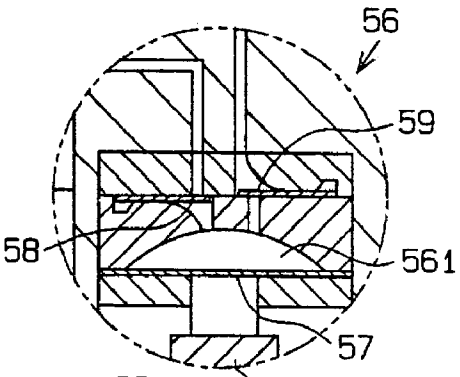
FIG. 7B is a partially enlarged cross-sectional view of a sub pump according to the second preferred embodiment of the present invention.
Figure 7A:
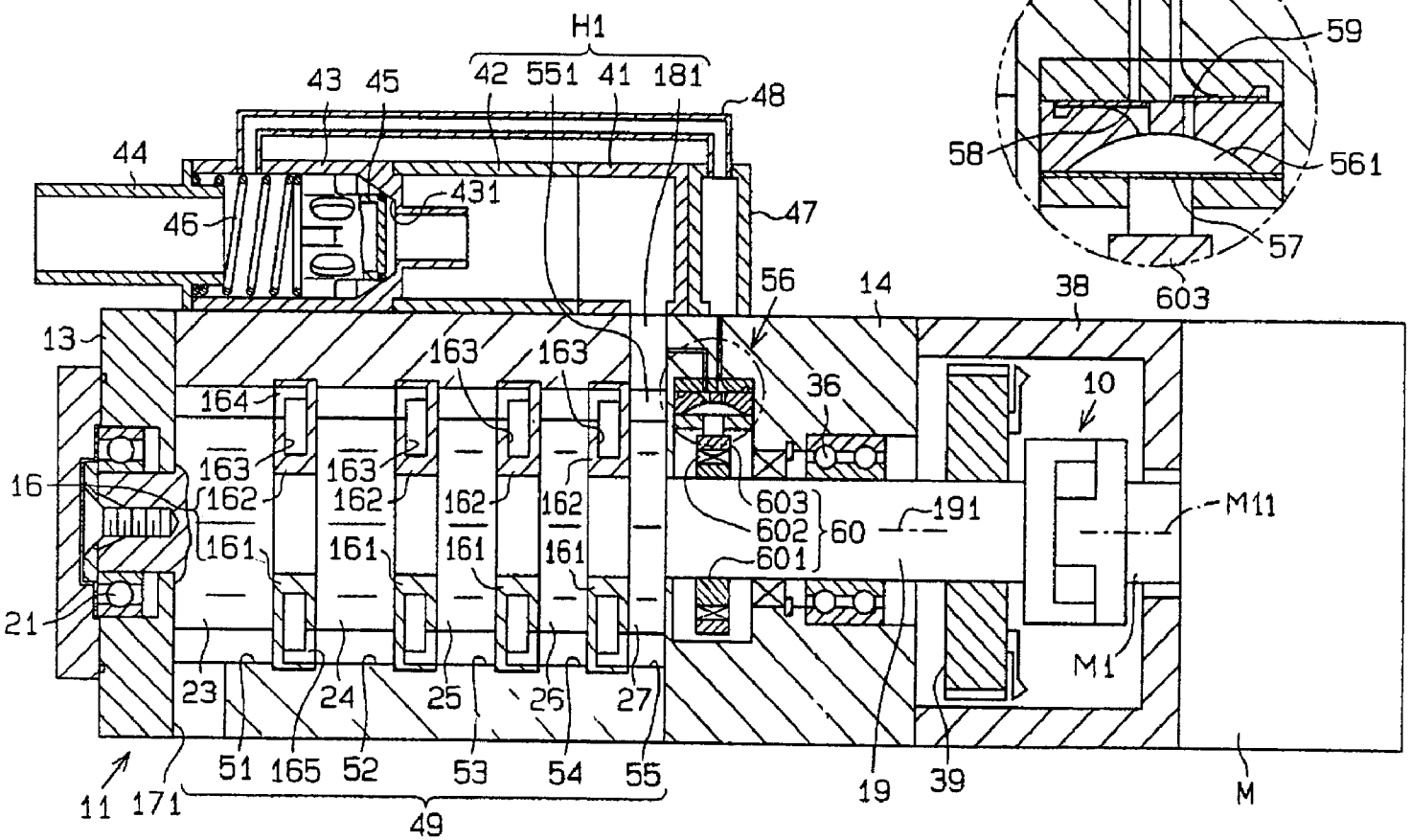
FIG. 7A is a longitudinal cross-sectional view of a multi-stage roots pump according to a second preferred embodiment of the present invention.

Now referring to FIG. 7A, a diagram illustrates a longitudinal cross-sectional view of the multi-stage roots pump 11 according to the second preferred embodiment of the present invention. A sub pump 56 is a diaphragm pump that includes a diaphragm 57, a suction valve 58 for preventing the gas from flowing back, a discharge valve 59 for preventing the gas from flowing back and a reciprocating drive mechanism 60. The reciprocating drive mechanism 60 includes a crankshaft 601, a radial bearing 602 and a ring cam 603. The crankshaft 601 is fixedly fitted around the rotary shaft 19. The ring cam 603 is supported by the crankshaft 601 through the radial bearing 602 so as to rotate relative to the crankshaft 601. The diaphragm 57 partially defines a pressure chamber 561. The ring cam 603 orbits around the axis 191 of the rotary shaft 19 in accordance with the rotation of the rotary shaft 19. The diaphragm 57 reciprocates by the orbital motion of the ring cam 603.

Now referring to FIG. 7B, a diagram illustrates a partially enlarged cross-sectional view of the sub pump 56 according to the second preferred embodiment of the present invention. As the diaphragm 57 moves downward in the drawing, the gas in the main pump chamber 55 of FIG. 7A is introduced into the pressure chamber 561 by pushing away the suction valve 58. As the diaphragm 57 moves upward in the drawing, the gas in the pressure chamber 561 is discharged into the flange 47 and the sub exhaust pipe 48 both shown in FIG. 7A by pushing away the discharge valve 59.

According to the second preferred embodiment of the present invention, the same advantageous effects as those in the first preferred embodiment are obtained. Additionally, since the sub pump 56 efficiently blocks the gas from flowing back, the sub pump 56 that is smaller in displacement volume than the sub pump 50 in the first preferred embodiment is optionally employed. Namely, the sub pump 56 may be smaller in size than the sub pump 50.

A third preferred embodiment of the present invention will now be described in reference to FIGS. 8 and 9. A screw type vacuum pump is employed in the third preferred embodiment. The same reference numerals denote the substantially identical components to those in the first preferred embodiment.

Figure 8:
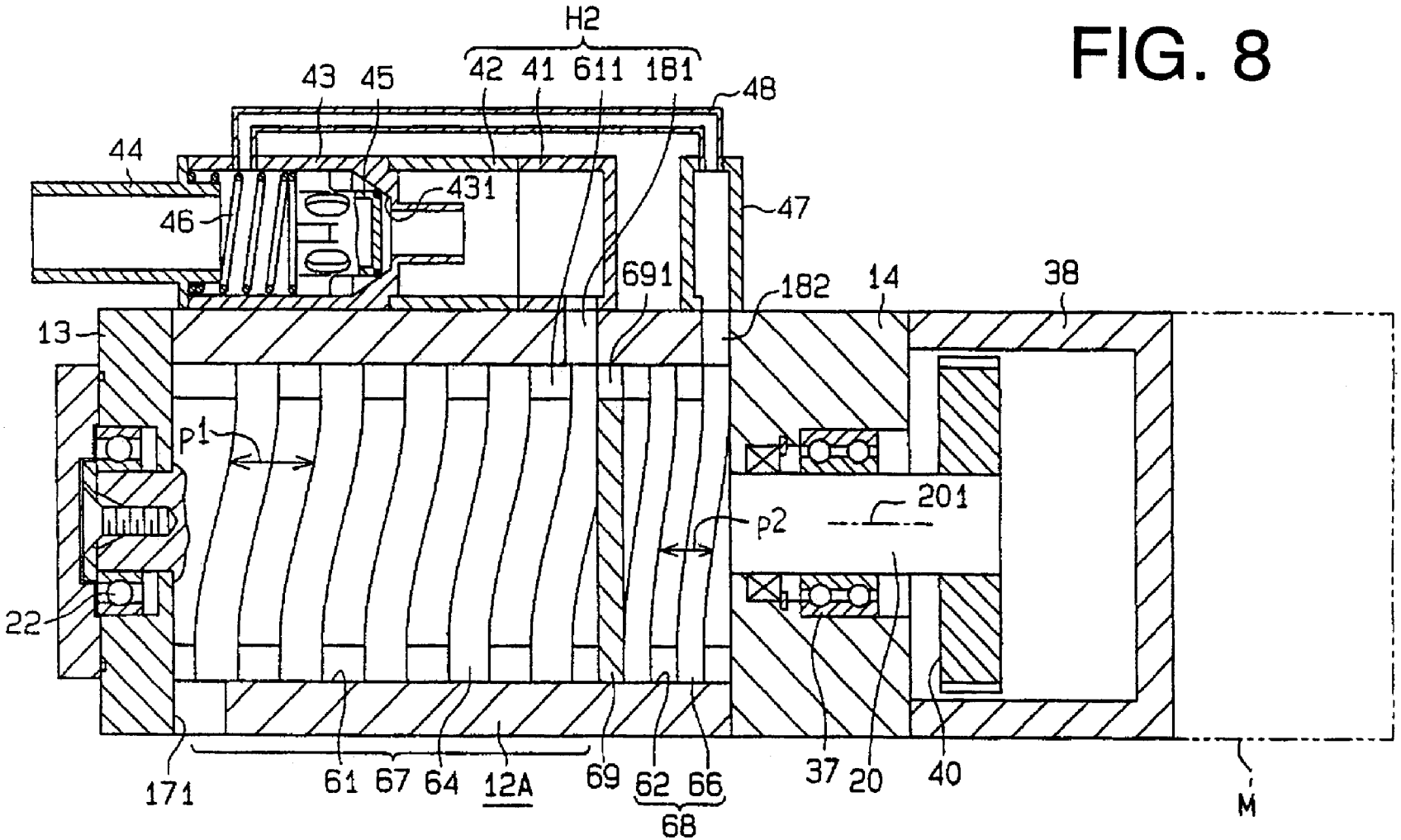
FIG. 8 is a longitudinal cross-sectional view of a screw pump according to a third preferred embodiment of the present invention.

Now referring to FIG. 8, a diagram illustrates a longitudinal cross-sectional view of a screw type vacuum pump according to the third preferred embodiment of the present invention. A main pump chamber 61 and a sub pump chamber 62 are defined in a rotor housing 12A. A semi-exhaust chamber 611 is defined in a portion of the main pump chamber 61 and communicates with the main exhaust port 181. An exhaust space H2 of the main pump 67 includes the semi-exhaust chamber 611, the main exhaust port 181 and the inner spaces of the flange 41 and the muffler 42.

Figure 9:
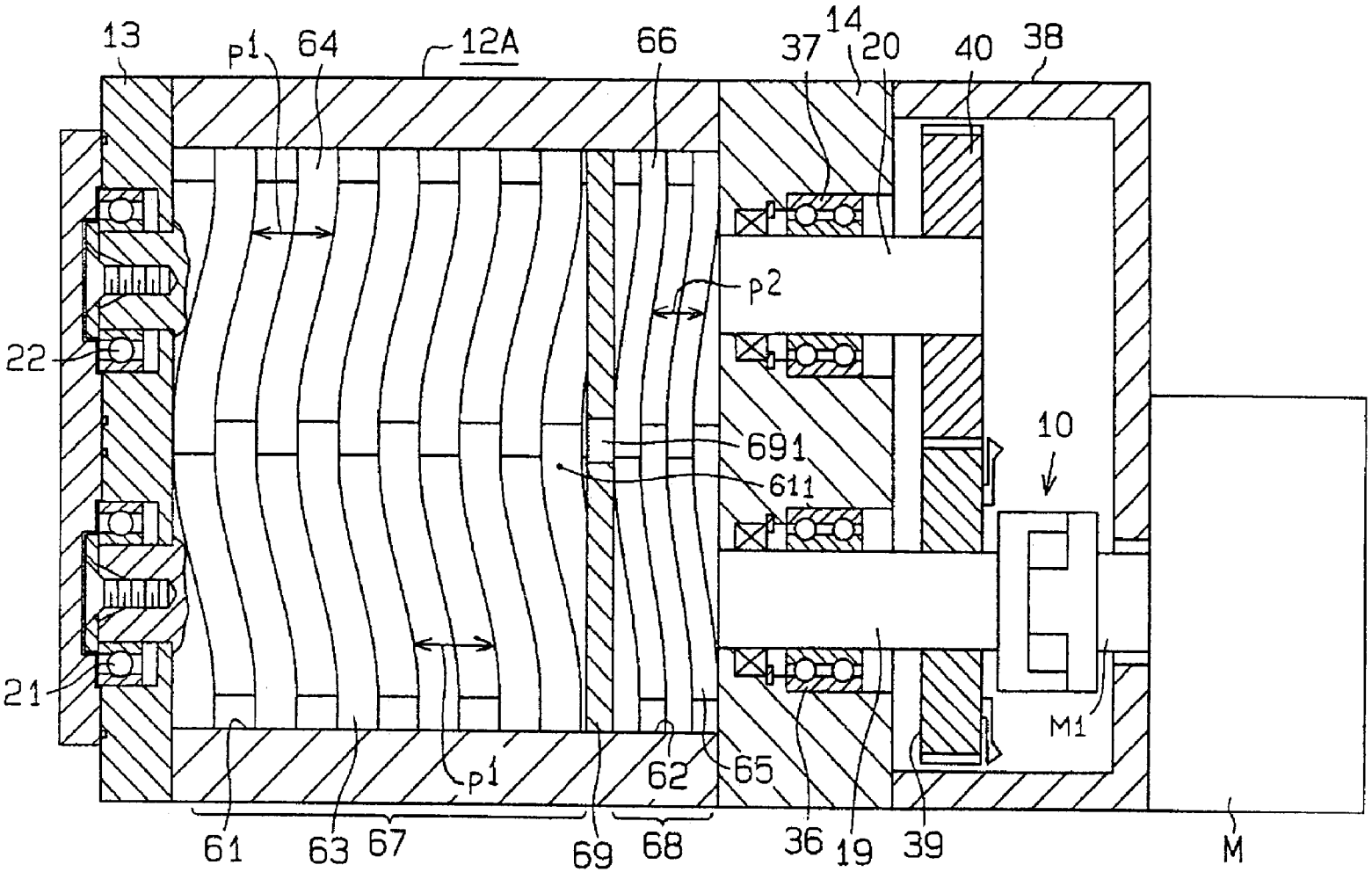
FIG. 9 is a cross-sectional plan view of the screw pump according to the third preferred embodiment of the present invention.

Now referring to FIG. 9, a diagram illustrates a cross-sectional plan view of the screw type vacuum pump according to the third preferred embodiment of the present invention. The main pump 67 includes the main pump chamber 61 and main screw rotors 63, 64. A sub pump 68 includes the sub pump chamber 62 and sub screw rotors 65, 66. The main screw rotors 63, 64 are accommodated in the main pump chamber 61. The sub screw rotors 65, 66 are accommodated in the sub pump chamber 62. A screw pitch p2 of the sub screw rotors 65, 66 is smaller than a screw pitch p1 of the main screw rotors 63, 64. Namely, the entrapping volume in the sub pump chamber 62 is smaller than that in the main pump chamber 61, and the sub pump 68 is smaller in displacement volume than the main pump 67. The main screw rotor 63 and the sub screw rotor 65 integrally rotate with the rotary shaft 19. The main screw rotor 64 and the sub screw rotor 66 integrally rotate with the rotary shaft 20. The semi-exhaust chamber 611 is defined by the main screw rotors 63, 64 in a portion of the main pump chamber 61.

Referring back to FIGS. 8 and 9, as the main screw rotors 63, 64 rotate, the gas is transferred from the intake port 171 to the main exhaust port 181. As the sub screw rotors 65, 66 of FIG. 9 rotate, the gas in the semi-exhaust chamber 611 is partially introduced into the sub pump chamber 62 through a passage 691 in a partition wall 69 and is discharged into the flange 47 and the sub exhaust pipe 48.

According to the third preferred embodiment, the same advantageous effects as mentioned in the paragraphs (1-1) and (1-2) in the first preferred embodiment are obtained.

A fourth preferred embodiment of the present invention will now be described in reference to FIGS. 10 through 12. The front side and the rear side of the multi-stage roots pump 11 respectively correspond to the left side and the right side of FIG. 10. The same reference numerals denote the substantially identical components to those in the first preferred embodiment.

Figure 10:
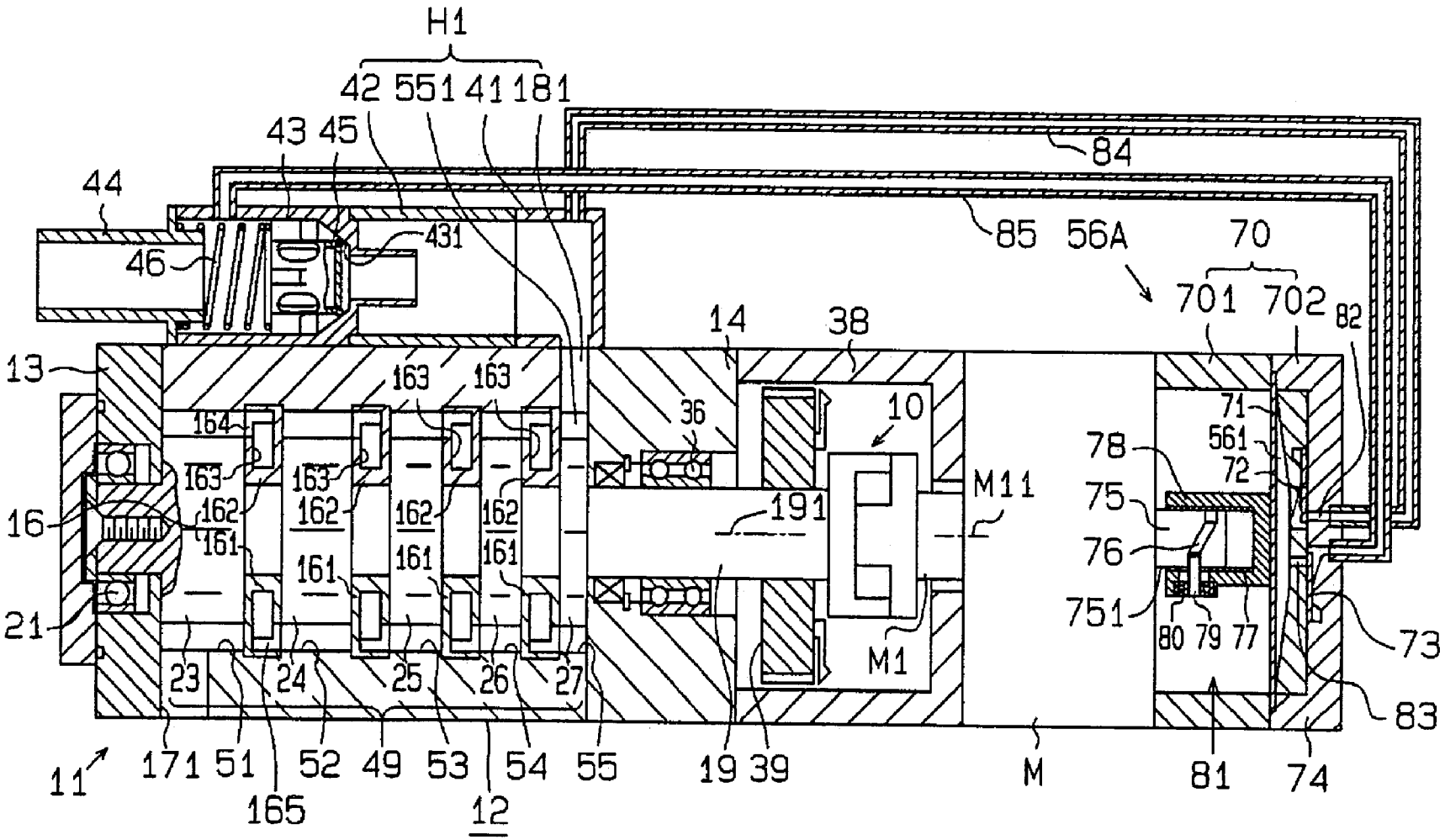
FIG. 10 is a longitudinal cross-sectional view of a multi-stage roots pump according to a fourth preferred embodiment of the present invention.

Now referring to FIG. 10, a diagram illustrates a longitudinal cross-sectional view of the multi-stage roots pump 11 according to the fourth preferred embodiment of the present invention. A sub pump 56A includes a pump housing 70 and is assembled to the gear housing 38. The pump housing 70 includes a cylindrical portion 701 and a shutter 702. The drive shaft M1 of the electric motor M protrudes into the cylindrical portion 701. The sub pump 56A is a diaphragm pump that includes a circular diaphragm 71, a suction valve 72, a discharge valve 73 and a cam mechanism 81. The peripheral portion of the diaphragm 71 is partially sandwiched by the cylindrical portion 701 and the shutter 702. The suction valve 72 and the discharge valve 73 prevent the gas from flowing back and are held between a retainer 74 and the front end surface of the shutter 702. The retainer 74 is fixedly connected to the shutter 702. The diaphragm 71 and the retainer 74 define the pressure chamber 561.

The cam mechanism 81 includes a cam portion 75, an annular groove 76, a guide cylinder 78, a roller 79 and a radial bearing 80. The cam mechanism 81 reciprocates the diaphragm 71 in a direction of an axis M11 of the drive shaft M1. The cam portion 75 is columnar in shape and is integrally formed with the protruded end of the drive shaft M1 in the pump housing 70. The annular groove 76 is recessed in a circumferential surface 751 of the cam portion 75 so as to make a round around the cam portion 75. A hypothetical plane including the annular groove 76 is inclined relative to a perpendicular plane with respect to the axis M11 of the drive shaft M1. A cylindrical bearing 77 is slidably fitted around the cam portion 75, and the guide cylinder 78 is fitted around the bearing 77. The guide cylinder 78 is supported by the columnar cam portion 75 through the bearing 77 and is slidable in the direction of the axis M11 of the drive shaft M1 along the circumferential surface 751 of the cam portion 75. The roller 79 is rotatably supported by the outer cylindrical portion of the guide cylinder 78 through the radial bearing 80. One end of the roller 79 is fitted in the annular groove 76. The guide cylinder 78 is connected to the middle portion of the diaphragm 71.

A suction passage 82 and a discharge passage 83 are formed in both the end plate of the shutter 702 and the retainer 74. The suction passage 82 communicates with the inner space of the flange 41 through a suction conduit 84, and the discharge passage 83 communicates with the inner space of the guide pipe 43 through a discharge conduit 85.

As the electric motor M is energized, the drive shaft M1 rotates so that the rotary shafts 19, 20 of FIG. 2 rotate. The gas in the region for being vacuumed is introduced into the main pump chamber 51 of the main pump 49 through the intake port 171. The vacuumed region is not shown in the drawing. The gas introduced into the main pump chamber 51 is transferred to the main pump chamber 55 through the main pump chambers 52 through 55 as it is compressed. The gas transferred into the main pump chamber 55 is exhausted into the flange 41 through the main exhaust port 181.

Figure 11:
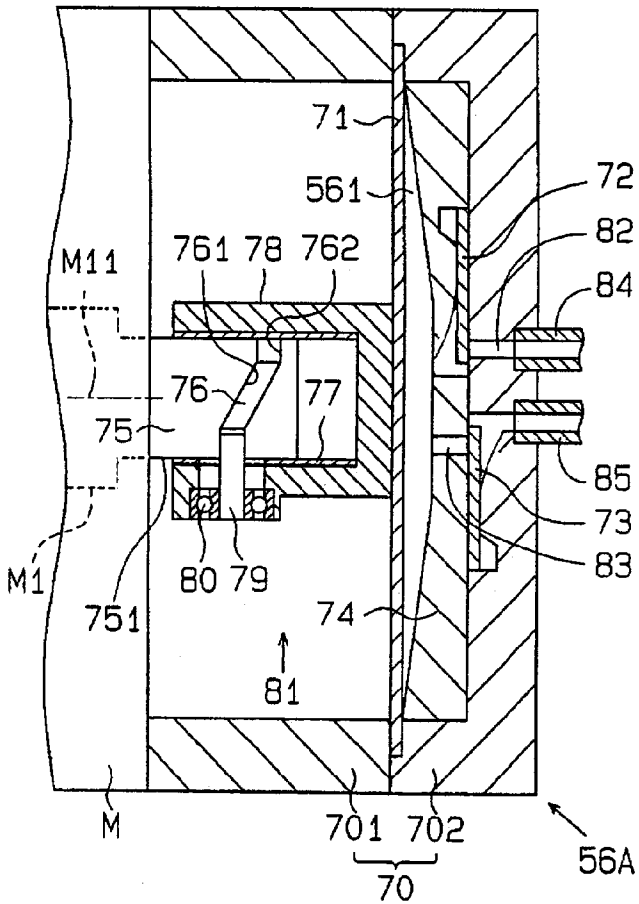
FIG. 11 is a partially enlarged cross-sectional view of a sub pump in a state when a diaphragm is positioned at a bottom dead center according to the fourth preferred embodiment of the present invention.

Now referring to FIG. 11, a diagram illustrates a partially enlarged cross-sectional view of the sub pump 56A in a state when the diaphragm 71 is positioned at a bottom dead center according to the fourth preferred embodiment of the present invention. As the cam portion 75 rotates, the roller 79 in the annular groove 76 is relatively guided along the annular groove 76. The roller 79, which is rotatably supported by radial bearing 80, relatively rolls on a side surface 761 of the annular groove 76 or on a side surface 762 of the annular groove 76. The roller 79 and the guide cylinder 78 integrally move in the direction of the axis M11 as they are relatively guided by the annular groove 76. When the roller 79 and the guide cylinder 78 are positioned the furthest from the retainer 74, that is, at the bottom dead center, as shown in the drawing, the volume in the pressure chamber 561 is maximum.

Figure 12:
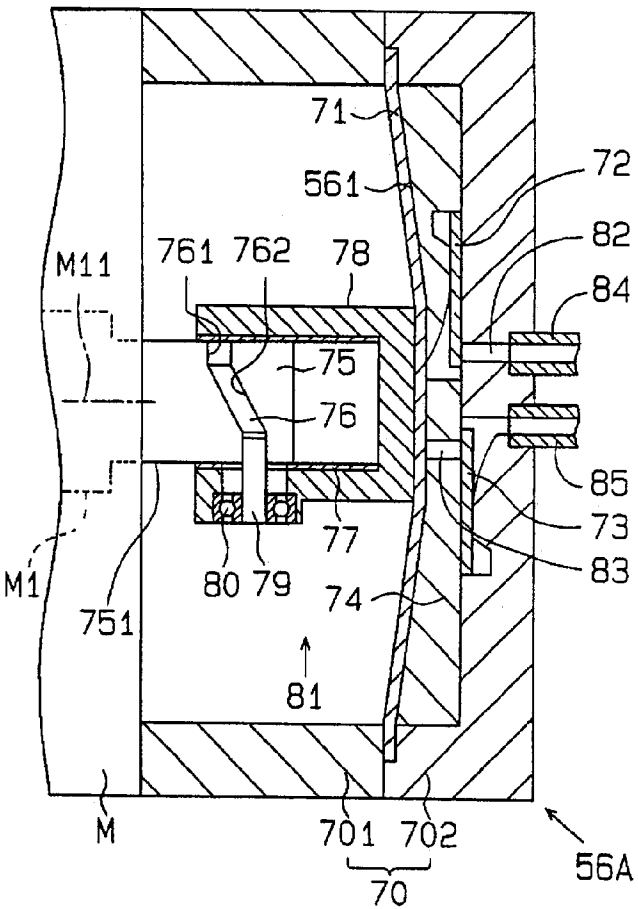
FIG. 12 is a partially enlarged cross-sectional view of the sub pump in a state when the diaphragm is positioned at a top dead center according to the fourth preferred embodiment of the present invention.

Now referring to FIG. 12, a diagram illustrates a partially enlarged cross-sectional view of the sub pump 56A in a state when the diaphragm 71 is positioned at a top dead center according to the fourth preferred embodiment of the present invention. As the drive shaft M1 continues to rotate from a state shown in FIG. 11, the roller 79 and the guide cylinder 78 move toward the retainer 74. As the drive shaft M1 rotates in a half circle from a state shown in FIG. 11, the roller 79 and the guide cylinder 78 are positioned the closest to the retainer 74, that is, at the top dead center. Then, the volume in the pressure chamber 561 is minimum. As the drive shaft M1 rotates in a half circle from a state shown in FIG. 12, the roller 79 and the guide cylinder 78 are positioned at the bottom dead center, as shown in FIG. 11. Namely, as the drive shaft M1 rotates in a complete circle, the roller 79 and the guide cylinder 78 complete one reciprocation in the direction of the axis M11.

As the guide cylinder 78 moves from the top dead center to the bottom dead center, the diaphragm 71 leaves from the retainer 74 so that the volume of the pressure chamber 561 increases. Due to the increase of the volume, the gas in the exhaust space H1 is introduced into the pressure chamber 561 by pushing away the suction valve 72. As the guide cylinder 78 moves from the bottom dead center to the top dead center, the diaphragm 71 approaches the retainer 74 so that the volume of the pressure chamber 561 reduces. Due to the reduction of the volume, the gas in the pressure chamber 561 is discharged to the guide pipe 43 by pushing away the discharge valve 73.

Referring back to FIG. 10, a main drive unit couples the electric motor M with the main pump 49 and includes the drive shaft M1, the shaft coupling 10, the gears 39, 40 and the rotary shafts 19, 20 as described in FIG. 2. A sub drive unit couples the electric motor M with the sub pump 56A and includes the cam portion 75. However, the sub drive unit does not include the portion of main drive unit.

According to the fourth preferred embodiment, in addition to the same advantageous effect mentioned in the paragraph (1-1) in the first preferred embodiment, the following advantageous effects are obtained.

(4-1) As distances between the radial bearings 21, 36 on the rotary shaft 19 and between the radial bearings 22, 37 on the rotary shaft 20 lengthen, the following problems occur.

When the roots pump 11 is horizontally used as shown in FIG. 1, as a distance between the radial bearings 21, 36 on the rotary shaft 19 lengthens, the rotary shaft 19 between the radial bearings 21, 36 tends to deform due to the weight of the main rotors 23 through 27 and the rotary shaft 19. Then, clearances between the front and rear end surfaces of the main rotors 23 through 27 and facing surfaces facing these end surfaces in the pump chambers 51 through 55 become large. For example, in the main rotor 23, the rear end surface of the front housing 13 and the front end surface of the partition wall 16 correspond to the above facing surfaces. As the clearance increases, the efficiency of gas transfer deteriorates. Likewise, the above problem also occurs on the rotary shaft 20.

As the temperature in the rotor housing 12 rises due to application of pressure to the gas, the rotary shaft 19 expands due to the rise of the temperature. As the rotary shaft 19 expands, the main rotors 23 through 27 are displaced in a direction of the axis 191 of the rotary shaft 19. When the displacement of the main rotors 23 through 27 are relatively large, the main rotors 23 through 27 may interfere with the facing surfaces that face the front and rear end surfaces of the main rotors 23 through 27. Then, when the displacement of the main rotors 23 through 27 are relatively large, the clearance between the front and rear end surfaces of the main rotors 23 through 27 and the facing surfaces needs a relatively large distance. However, when the clearance increases, the efficiency of gas transfer deteriorates. Likewise, the above problem also occurs on the rotary shaft 20.

When the sub pump 56A is driven by the cam portion 75 provided on the drive shaft M1, distances between the radial bearings 21, 36 on the rotary shaft 19 and between the radial bearings 22, 37 on the rotary shaft 20 are determined at a necessary and minimum value. As a result, the clearances between the front and rear end surfaces of the main rotors 23 through 32 and the facing surfaces become relatively small so that the efficiency of gas transfer does not deteriorate.

(4-2) A space on the rear side of the electric motor M, that is, on the opposite side to the rotary shaft 19 relative to the electric motor M, does not have any components that interfere with an assembling of the sub pump 56A. When the sub pump 56A is located on the rear side of the electric motor M, there is only a few design requirements so that the sub pump 56A is easily assembled.

(4-3) The displacement volume of the sub pump 56A is determined by the diameter of the diaphragm 71 and the stroke distance of the center of the diaphragm 71 in the direction of the axis M11. When the displacement volume of the sub pump 56A needs to be determined at a certain volume, as the diameter of the diaphragm 71 increases, the stroke distance of the diaphragm 71 reduces.

The diaphragm 71 is located to cross a hypothetical extended line of the axis M11 of the drive shaft M1. Such arrangement of the diaphragm 71 allows the diameter of the diaphragm 71 to increase in accordance with the diameter of the cylindrical portion 701 of the pump housing 70. Namely, as the stroke distance of the diaphragm 71 reduces, the deformation of the diaphragm 71 in accordance with the reciprocation of the diaphragm 71 reduces. The deformation of the diaphragm 71 in accordance with the reciprocation of the diaphragm 71 means bending of the diaphragm 71 that contacts the circular end surface of the guide cylinder 78 near the periphery and bending of the peripheral portion of the diaphragm 71 that contacts the pump housing 70. As the deformation of the diaphragm 71 reduces, durability of the diaphragm 71 improves so that reliability of the sub pump 56A improves.

A fifth preferred embodiment of the present invention will now be described in reference to FIG. 13. The front side and the rear side of the multi-stage roots pump 11 respectively correspond to the left side and the right side of FIG. 13. The same reference numerals denote the substantially identical components to those in the second preferred embodiment.

Figure 13:
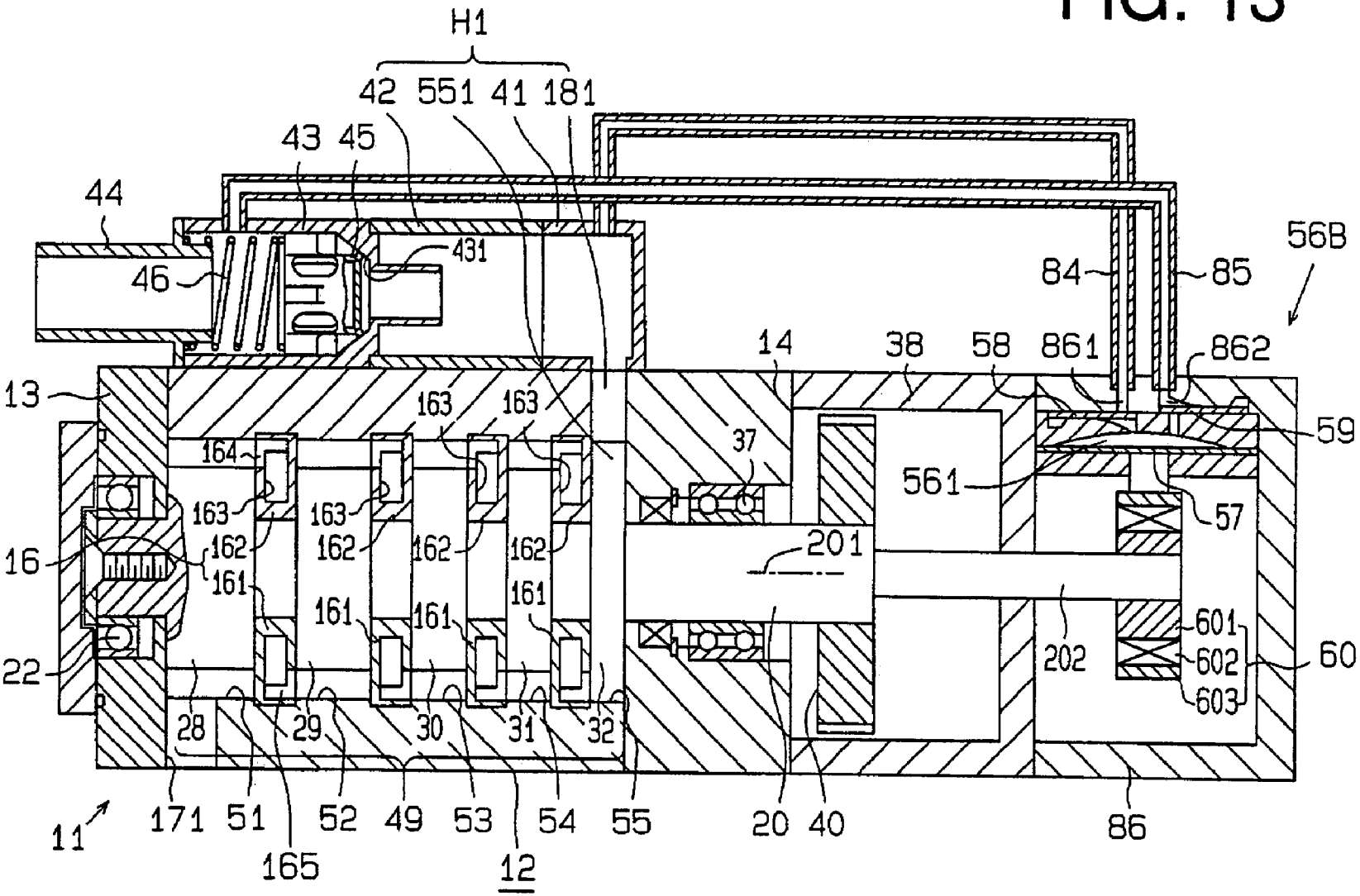
FIG. 13 is a longitudinal cross-sectional view of a multi-stage roots pump according to a fifth preferred embodiment of the present invention.

Now referring to FIG. 13, a diagram illustrates a longitudinal cross-sectional view of the multi-stage roots pump 11 according to the fifth preferred embodiment of the present invention. A sub pump 56B includes a pump housing 86 that is assembled to the gear housing 38. The sub pump 56B is located near the rear side of the rotary shaft 20. A small diameter portion 202 is integrally formed with the rear end of the rotary shaft 20. The small diameter portion 202 protrudes into the pump housing 86 through the end wall of the gear housing 38. The same components as those of the sub pump 56 in the second preferred embodiment are accommodated in the pump housing 86. The same reference numerals of the sub pump 56B denote the substantially identical components to those of the sub pump 56.

A suction passage 861 and a discharge passage 862 are formed in the circumferential wall of the pump housing 86. The suction passage 861 communicates with the inner space of the flange 41 through a suction conduit 84, and the discharge passage 862 communicates with the inner space of the guide pipe 43 through a discharge conduit 85.

The ring cam 603 orbits relative to the small diameter portion 202 in accordance with the rotation of the small diameter portion 202 that integrally rotates with the rotary shaft 20. The diaphragm 57 reciprocates as the ring cam 603 orbits relative to the small diameter portion 202. As the diaphragm 57 moves downward, the gas in the flange 41 is introduced into the pressure chamber 561 by pushing away the suction valve 58. As the diaphragm 57 moves upward, the gas in the pressure chamber 561 is discharged into the flange 47 by pushing away the discharge valve 59.

The main drive unit couples the electric motor M with the main pump 49 and includes the drive shaft M1, the shaft coupling 10, the gears 39, 40 and the rotary shafts 19, 20 as described in FIG. 2. The sub drive unit couples the electric motor M with the sub pump 56B and includes the small diameter portion 202, the drive shaft M1, the shaft coupling 10, the portion of rotary shafts 19, 20 and the gears 39, 40. Namely, the sub drive unit partially includes the main drive unit. The sub pump 56B is directly connected to the portion of sub drive unit other than the portion of main drive unit so as to be driven through the sub drive unit.

According to the fifth preferred embodiment, the advantageous effects mentioned in the paragraphs (4-1) and (4-2) in the fourth preferred embodiment are obtained.

A sixth preferred embodiment of the present invention will now be described in reference to FIG. 14. The same reference numerals denote the substantially identical components to those in the fourth preferred embodiment.

Figure 14:
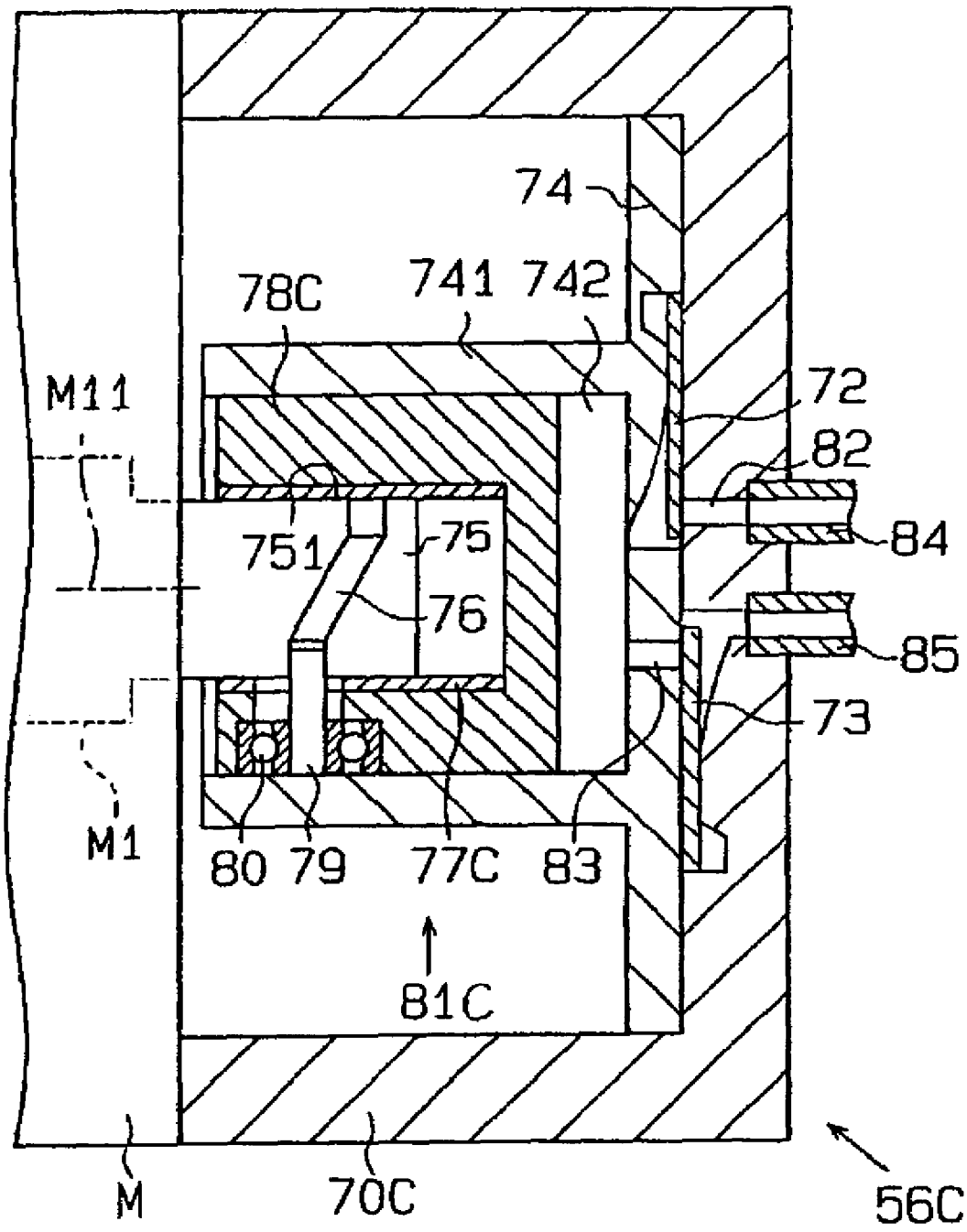
FIG. 14 is a partially enlarged cross-sectional view of a sub pump according to a sixth preferred embodiment of the present invention.

Now referring to FIG. 14, a diagram illustrates a partially enlarged cross-sectional view of a sub pump 56C according to the sixth preferred embodiment of the present invention. The sub pump 56C includes a pump housing 70C that is formed with a single component. A cylindrical boss 741 is integrally formed with the retainer 74. A cam mechanism 81C includes the cam portion 75, the annular groove 76, the roller 79, the radial bearing 80 and a guide cylinder 78C. The cam mechanism 81C reciprocates the guide cylinder 78C in the direction of the axis M11. The guide cylinder 78C is slidably fitted in the cylindrical boss 741 but is blocked from rotating. The guide cylinder 78C is supported by the cam portion 75 through a bearing 77C. The guide cylinder 78C functions as the guide cylinder 78C in the fourth preferred embodiment. As the cam portion 75 rotates, the guide cylinder 78C moves in the direction of the axis M11. The guide cylinder 78C and the cylindrical boss 741 define a pressure chamber 742. Namely, the guide cylinder 78C functions as a piston for varying the displacement volume of the sub pump 56C.

According to the sixth preferred embodiment, the same advantageous effects mentioned in the paragraph (1-1) in the first preferred embodiment and in the paragraphs (4-1) and (4-2) in the fourth preferred embodiment.

The present invention is not limited to the embodiments described above but may be modified into the following alternative embodiments.

(1) In alternative embodiments to the above second, fourth and fifth preferred embodiments, the diaphragm in the sub pumps 56, 56A, 56C is replaced by a bellows.

(2) In alternative embodiments to the above third preferred embodiment, the sub pump 68 in the third preferred embodiment is replaced by the sub pump 56 in the second preferred embodiment.

(3) In alternative embodiments to the above third preferred embodiment, the sub pump 68 in the third preferred embodiment is replaced by one of the sub pumps 56A, 56B, 56C in the fourth through sixth preferred embodiments, respectively.

(4) In alternative embodiments to the above preferred embodiments, a sub pump is located near the front housing 13, and the sub pump is driven through the front end of the rotary shafts 19, 20, that is, through the front housing side of the rotary shafts 19, 20.

When the sub pump 56A in the fourth preferred embodiment is driven through the front end of the rotary shaft 19, the cam portion 75 is provided on the front end of the rotary shaft 19. In this state, the sub drive unit includes the drive shaft M1, the shaft coupling 10 and the rotary shaft 19. The sub drive unit transmits power from the electric motor M to the sub pump 56A. The sub drive unit partially includes the main drive unit that transmits power to the main pump 49 through the rotary shafts 19, 20.

When the sub pump 56A in the fourth preferred embodiment is driven through the front end of the rotary shaft 20, the cam portion 75 is provided on the front end of the rotary shaft 20. In this state, the sub drive unit includes the drive shaft M1, the shaft coupling 10, the rotary shaft 19, 20, the gears 39, 40 and the cam portion 75. The sub drive unit transmits power from the electric motor M to the sub pump 56A. The sub drive unit partially includes the main drive unit that transmits power to the main pump 49 through the rotary shafts 19, 20.

(5) In alternative embodiments to the above second and fourth through sixth preferred embodiments, in the sub pumps 56, 56A, 56B, 56C, the flapper suction valves 58, 72 and the flapper discharge valves 59, 73 are replaced by a ball valve body.

(6) In alternative embodiments to the above preferred embodiments, the present invention is applied to a vacuum pump other than the roots pump and the screw pump.

Therefore, the present examples and embodiments are to be considered as illustrative and not restrictive, and the invention is not to be limited to the details given herein but may be modified within the scope of the appended claims.

What is claimed is:

1. A vacuum pump comprising:

a main pump including a pump chamber and a gas transferring body that is located in the pump chamber and an exhaust space communicating with the pump chamber, the main pump being driven by a drive source through a rotary shaft for transferring gas to the exhaust space;

a check valve located downstream of the exhaust space for preventing the gas from flowing back;

a sub pump connected to the exhaust space for partially exhausting the gas from the exhaust space, the sub pump being driven by the same drive source, the displacement volume of the sub pump being smaller than that of the main pump; and an exhaust passage of the sub pump communicating with a gas passage downstream of the check valve, wherein said main pump is a roots pump, the roots pump comprising:

a plurality of rotary shafts located parallel to each other, wherein one of the rotary shafts is driven by the drive source of the roots pump;

a plurality of the main rotors as gas transferring bodies respectively connected to the rotary shafts, the main rotors on coadjacent rotary shafts being engaged with each other; and a plurality of the main pump chambers as the pump chamber accommodating a set of the engaged main rotors, one of which has a minimum volume and communicates with the exhaust space, and wherein said sub pump is a diaphragm pump including a diaphragm, a suction valve and a discharge valve, the diaphragm being positioned such that the plane of the diaphragm intersects a hypothetical extended line of an axis of the rotary shaft being driven by the drive source of the roots pump.

2. The vacuum pump according to claim 1, wherein the sub pump is located inside a housing of the vacuum pump.

3. The vacuum pump according to claim 1, wherein the sub pump includes a sub pump chamber that is smaller in volume than the main pump chamber having the minimum volume.

4. The vacuum pump according to claim 1, wherein the vacuum pump includes a sub drive unit coupling the drive source with the sub pump for driving the sub pump.

5. The vacuum pump according to claim 4, wherein the sub drive unit partially includes a main drive unit that transmits power from the drive source to the main pump through the rotary shaft.

6. The vacuum pump according to claim 4, wherein the sub drive unit is provided separately from a main drive unit that transmits power from the drive source to the main pump through the rotary shaft.

7. The vacuum pump according to claim 4, wherein the sub drive unit is connected to the drive source on the opposite side to the rotary shaft relative to the drive source, the sub pump and the rotary shaft being located on opposite sides of the drive source.

8. The vacuum pump according to claim 1, wherein the sub pump is located near the exhaust space.

* * * * *

UNITED STATES PATENT AND TRADEMARK OFFICE

CERTIFICATE OF CORRECTION

PATENT NO. : 7,140,846 B2
APPLICATION NO. : 10/391904
DATED : November 28, 2006
INVENTOR(S) : Shinya Yamamoto et al.

It is certified that error appears in the above-identified patent and that said Letters Patent is hereby corrected as shown below:

Column 10, line 6, please delete "there is" and insert therefore -- there are --; and Column 11, line 38 claim 1, please delete "embodiment." and insert therefore -- embodiment are obtained. --.

Signed and Sealed this

Twenty-fourth Day of November, 2009

David J. Kappos

David J. Kappos
*Director of the United States Patent and Trademark Office*